US007944779B2

(12) United States Patent
Lee et al.

(10) Patent No.: US 7,944,779 B2
(45) Date of Patent: May 17, 2011

(54) MULTIFUNCTION TIME DISPLAY DEVICE

(75) Inventors: Chia-Ying Lee, Taipei (TW); Yen-Chiu Hsu, Taipei (TW); Ai-Ling Lu, Taipei (TW); Mei-Lin Chan, Taipei (TW)

(73) Assignee: Pegatron Corporation, Taipei (TW)

( * ) Notice: Subject to any disclaimer, the term of this patent is extended or adjusted under 35 U.S.C. 154(b) by 0 days.

(21) Appl. No.: 12/566,244

(22) Filed: Sep. 24, 2009

(65) Prior Publication Data

US 2010/0074061 A1 Mar. 25, 2010

(30) Foreign Application Priority Data

Sep. 25, 2008 (TW) ..... 97136960 A

(51) Int. Cl.
*G04C 23/18* (2006.01)

(52) U.S. Cl. ..... 368/252; 368/309; 368/315

(58) Field of Classification Search ..... 368/80, 368/93, 96, 276, 309, 315, 244, 250–252, 368/256, 327
See application file for complete search history.

(56) References Cited

U.S. PATENT DOCUMENTS

| | | | | | |
|---|---|---|---|---|---|
| 470,816 | A | * | 3/1892 | Bennett | 368/253 |
| 528,678 | A | * | 11/1894 | McDonnell | 368/253 |
| 982,839 | A | * | 1/1911 | McDonald | 200/36 |
| 1,113,279 | A | * | 10/1914 | Adland | 368/252 |
| 1,311,424 | A | * | 7/1919 | Spargo | 368/252 |
| 3,187,319 | A | * | 6/1965 | Crawford | 368/108 |
| 3,522,535 | A | * | 8/1970 | Adams | 356/229 |
| 4,228,649 | A | * | 10/1980 | Weiss | 368/93 |
| 5,105,397 | A | * | 4/1992 | Whitney | 368/80 |
| 5,305,291 | A | * | 4/1994 | Kamens et al. | 368/252 |
| 2007/0201317 | A1 | * | 8/2007 | Houlon | 368/281 |

FOREIGN PATENT DOCUMENTS

| | | |
|---|---|---|
| CN | 2266141 | 10/1997 |
| TW | 00181688 | 8/1996 |

OTHER PUBLICATIONS

Novelty Search Report, Search date Jun. 25, 2008.

* cited by examiner

*Primary Examiner* — Sean Kayes

(74) *Attorney, Agent, or Firm* — Thomas, Kayden, Horstemeyer & Risley, LLP

(57) ABSTRACT

A multifunction time display device includes a main body, a first element, a second element, and an indication element. The main body includes a casing, and the casing possesses a transparent portion. The first element moves inside the casing as time goes by. The second element is removably attached to any position of the transparent portion of the casing. The indication element is triggered when the first element moves to overlap the second element.

14 Claims, 4 Drawing Sheets

MULTIFUNCTION TIME DISPLAY DEVICE

CROSS-REFERENCE TO RELATED APPLICATIONS

This Non-provisional application claims priority under 35 U.S.C. §119(a) on Patent Application No(s). 097136960 filed in Taiwan, Republic of China on Sep. 25, 2008, the entire contents of which are hereby incorporated by reference.

BACKGROUND OF THE INVENTION

1. Field of the Invention

The invention relates to a time display device and, more particularly, to a time display device having a plurality of time management functions.

2. Description of the Related Art

With acceleration of modern people's life pace, how to effectively manage time has become an important issue, for example, a clock is a common auxiliary tool for time management. Particularly, the clock can sound at the set time to remind users as time is set in advance.

Rotating a knob at a rear surface of the clock and allow an alarm hand at a front surface of the clock to conform to the set alarm time is mostly used for setting alarm time of a clock at present. As the set alarm time reaches, an hour hand of the clock may stack with the alarm hand of the clock thus to trigger an alarm of the clock to remind users.

According to the prior art, certain time for rotating the knob is needed. However, the abovementioned method is inconvenient.

BRIEF SUMMARY OF THE INVENTION

One objective of this invention is to provide a multifunction time display device for effectively performing time management and increasing types of a time management event.

The invention provides a multifunction time display device including a main body, a first element, a second element, and an indication element. The main body includes a casing, and the casing possesses a transparent portion. The first element moves inside the casing as time goes by. The second element is removably attached to any position of the transparent portion of the casing. The indication element is triggered while the first element moves to overlap the second element.

The indication element may be disposed in the casing or in the second element. The second element may include a magnet. The main body may further include a metal plate disposed in the casing. Thus, the second element may be attached to the transparent portion of the casing via magnetism. The second element may be removably attached to any position of the transparent portion opposite to the moving range of the first element. The first element may be an hour hand or a minute hand. The indication element may be a sound element or a message element. The second element may have a retaining portion.

The multifunction time display device may further include a sensor electrically connected with the indication element to sense whether the first element moves to overlap the second element. In a preferred embodiment, the sensor may be a Hall sensor disposed on the first element. In another preferred embodiment, the sensor may be a photoresistor disposed on the second element, and further, the main body may include a luminescent plate and the first element may be a light-proof element. In a further preferred embodiment, the sensor may be an electromagnetic sensor including a transmitter and a receiver disposed on the first element and the second element, respectively.

The multifunction time display device can provide different time management functions via the different second elements. The second element is removably attached to the transparent portion of the casing. In other words, a user can intuitively put the second element on a position opposite to a time management event expected to happen. And then, the corresponding indication element is triggered while the first element overlaps the second element.

These and other features, aspects, and advantages of the present invention will become better understood with regard to the following description, appended claims, and accompanying drawings.

DETAILED DESCRIPTION OF THE INVENTION

Figure 1:
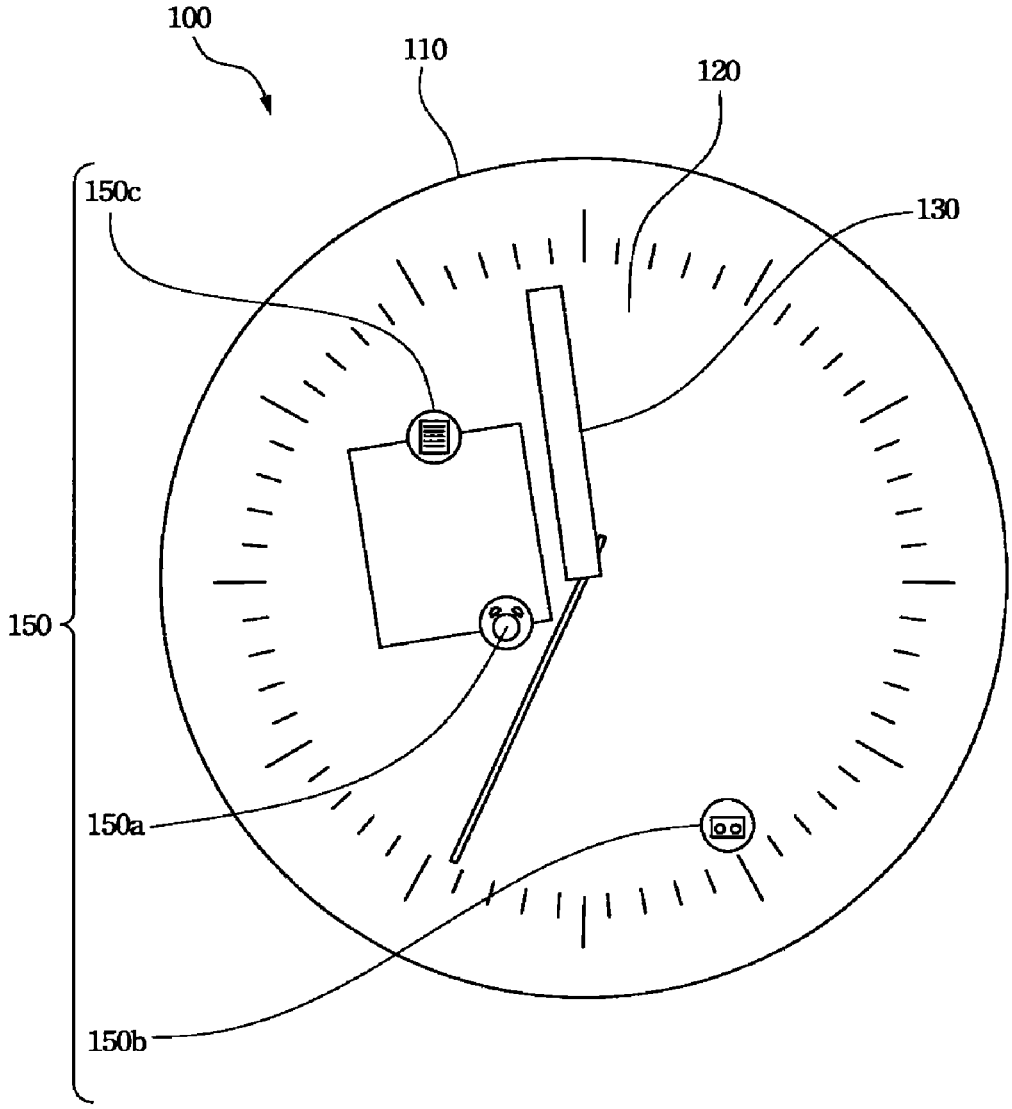
FIG. 1 is a schematic diagram showing a multifunction time display device according to a preferred embodiment of the invention.

FIG. 1 is a schematic diagram showing a multifunction time display device according to a preferred embodiment of the invention. Please refer to FIG. 1, a multifunction time display device 100 includes a main body 110, a first element 130, a second element 150 and an indication element (not shown). The main body 110 includes a casing (not shown), and the casing possesses a transparent portion 120 for exposing an internal structure of the main body 110. The first element 130 moves inside the casing as time goes by. In the presented invention, the first element 130 may be an hour hand or a minute hand.

The second element 150 is removably attached to any position of the transparent portion 120. The second elements 150*a*, 150*b*, 150*c* have different time management functions, such as an alarm function, a message function or a memo function and so on.

The indication elements are disposed opposite to the different second elements 150*a*, 150*b*, 150*c*, for example, the indication element may be a sound element as a time management event corresponding to the second element 150*a* is an alarm. The indication element may be a message element as a time management event corresponding to the second element 150*b* is a message; moreover, the second element 150*c* may have a retaining portion as a time management event corresponding to the second element 150*c* is a memo. The second element 150 with different functions may have different patterns, colors or shapes on its surface for distinguishing.

In addition, the second element 150*a* with the alarm function and the second element 150*c* with the memo function can operate independently. In other words, the second element 150*a* and 150*c* can also be combined for use. According to aforementioned, the second element 150*a* with the alarm function may be disposed at a designate position of the transparent portion 120, and a memo having a backlog list may be retained at the second element 150*c* having a retaining portion. When a sensor senses that the first element 130 overlaps the second element 150*a*, a signal is transmitted to trigger a sound element corresponding to the second element 150*a*. A user needs to move the second element 150*a* away from the set time while the user hears the alarm of the sound element. At that time, the user can see the memo retained at the second element 150, therefore, the user is reminded to do the backlog.

The multifunction time display device 100 further includes a sensor. When the sensor senses that the first element 130 overlaps the second element 150, the sensor can transmit a signal to trigger the indication element corresponding to the second element 150, thereby to perform the time management event corresponding to the second element 150.

The second element 150 is preferably disposed at any position of the transparent portion 120 opposite to a moving range of the first element 130. According to time when the event is expected to happen, the second element 150 can be disposed at a position opposite to the time. For example, if a user hopes for reminding himself or herself to take medicine at five o'clock, the user can leave a message in the second element 150*b* with the message function in advance. Then, the second element 150*b* is disposed at a designate position opposite to five o'clock. When the first element 130 moves to the designate position opposite to five o'clock, the sensor may sense that the first element 130 overlaps the second element 150*b* and transmit a signal to trigger the message at the indication element to remind the user that it is time for taking medicine.

In the presented invention, the user can dispose the second element 150 with different functions at the corresponding position of the main body 110 according to different time management functions and different events, therefore, the event setting mode of the multifunction time display device 100 is intuitive and effectively satisfies time management needs of modern people.

Figure 2:
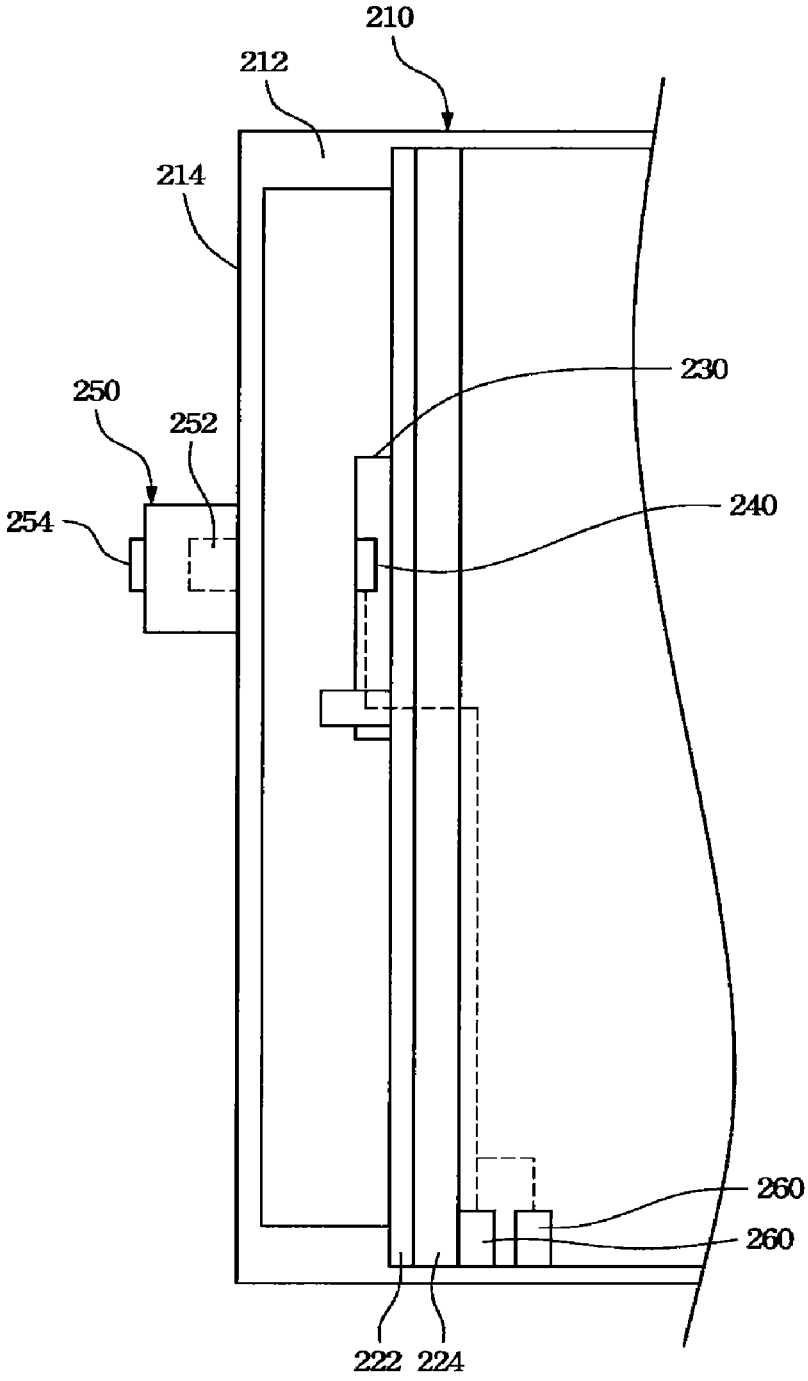
FIG. 2 is a side view showing a multifunction time display device according to a first embodiment of the invention.

FIG. 2 is a side view showing a multifunction time display device according to a first embodiment of the invention. Please refer to FIG. 2, a casing 212 of a main body 210 includes a transparent portion 214. The main body 210 includes a clock face 222 and a metal plate 224. The clock face 222 has patterns such as a number or a scale. A first element 230 may be an hour hand or a minute hand and uses its one end as a pivot to rotate on the clock face 222 as time goes by. The second element 250 includes a magnet 252 and attached to the transparent portion 214 of the casing 212 via magnetism.

In this embodiment, the sensor may be a Hall sensor 240 disposed on the first element 230 for sensing a change of magnetic lines and determining whether the first element 230 overlaps the second element 250. An indication element 260 corresponding to the second element 250 is disposed in the casing 212 of the main body 210 and is electrically connected with the Hall sensor 240. The second element 250 can further have a linear indicator 254. The linear indicator 254 is painted on a surface of the second element 250 for indicating the position of the magnet 252, and therefore, the second element 250 can accurately set event happening time.

The Hall sensor 240 can sense the magnetic lines of the magnet 252 in the second element 250 to determine that the first element 230 reaches the set time while the first element 230 moves to overlap the second element 250 disposed at the set time. The Hall sensor 240 can further transmit a signal to the corresponding indication element 260 to trigger the time management function.

The different second elements 250 have the different time management functions, and therefore, the magnets 252 in the second elements 250 can have different magnetic strength or magnetic pole directions according to the different time management functions. The Hall sensor 240 on the first element 230 can distinguish the different second element 250 through the different magnetic strength or magnetic pole directions and trigger the indication element 260 corresponding to the different second element 250.

Figure 3:
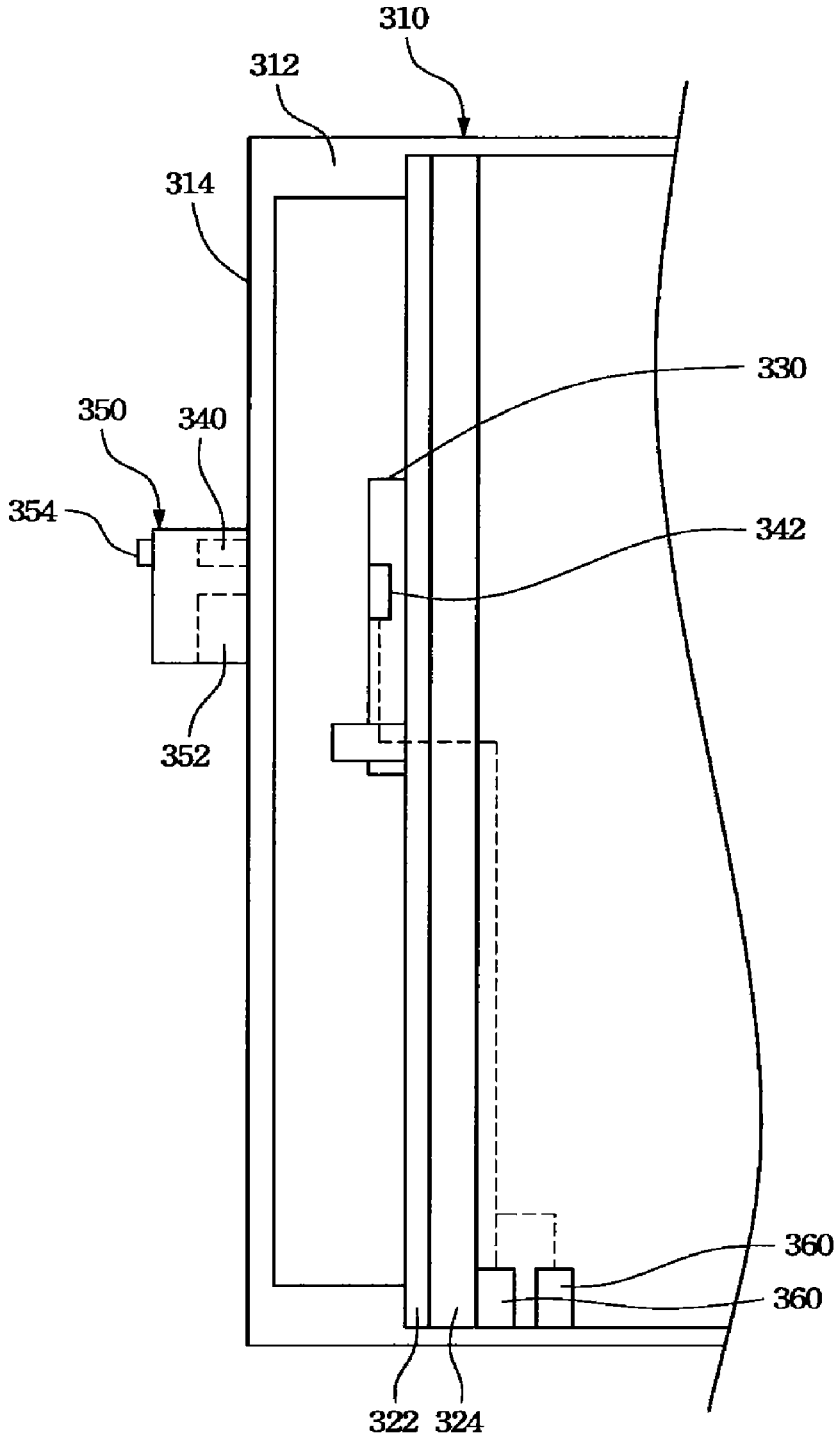
FIG. 3 is a side view showing a multifunction time display device according to a second embodiment of the invention.

FIG. 3 is a side view showing a multifunction time display device according to a second embodiment of the invention. Please refer to FIG. 3, a casing 312 of a main body 310 includes a transparent portion 314. The main body 310 further includes a clock face 322 and a metal plate 324. A first element 330 moves on the clock face 322 as time goes by. The second element 350 is removably attached to the transparent portion 314 of the casing 312 of the main body 310 via a magnet 352.

In this embodiment, a sensing element can include an electromagnetic transmitter 340 and an electromagnetic receiver 342. The electromagnetic transmitter 340 is disposed on the second element 350, and the electromagnetic receiver 342 is disposed on the first element 330. An indication element 360 is disposed in the casing 312 of the main body 310 and is electrically connected with the electromagnetic receiver 342. A linear indicator 354 of the second element 350 corresponds to the electromagnetic transmitter 340 for increasing accuracy of the time setting.

The electromagnetic receiver 342 can receive a signal transmitted from the electromagnetic transmitter 340 while the first element 330 moves to overlap the second element 350 disposed at the set time, thus to determine that the first element 330 reaches the set time. The electromagnetic receiver 342 can further transmit a signal to the corresponding indication element 360 to trigger the time management function.

The different second elements 350 have the different time management functions and therefore, the electromagnetic transmitter 340 in each second element 350 transmits an electromagnetic wave with different bands to allow the sensing element to effectively distinguish the second elements 350 with the different functions. And then, the electromagnetic receiver 342 can distinguish the second elements 350 to trigger the indication element 360 corresponding to the second element 350.

Figure 4:
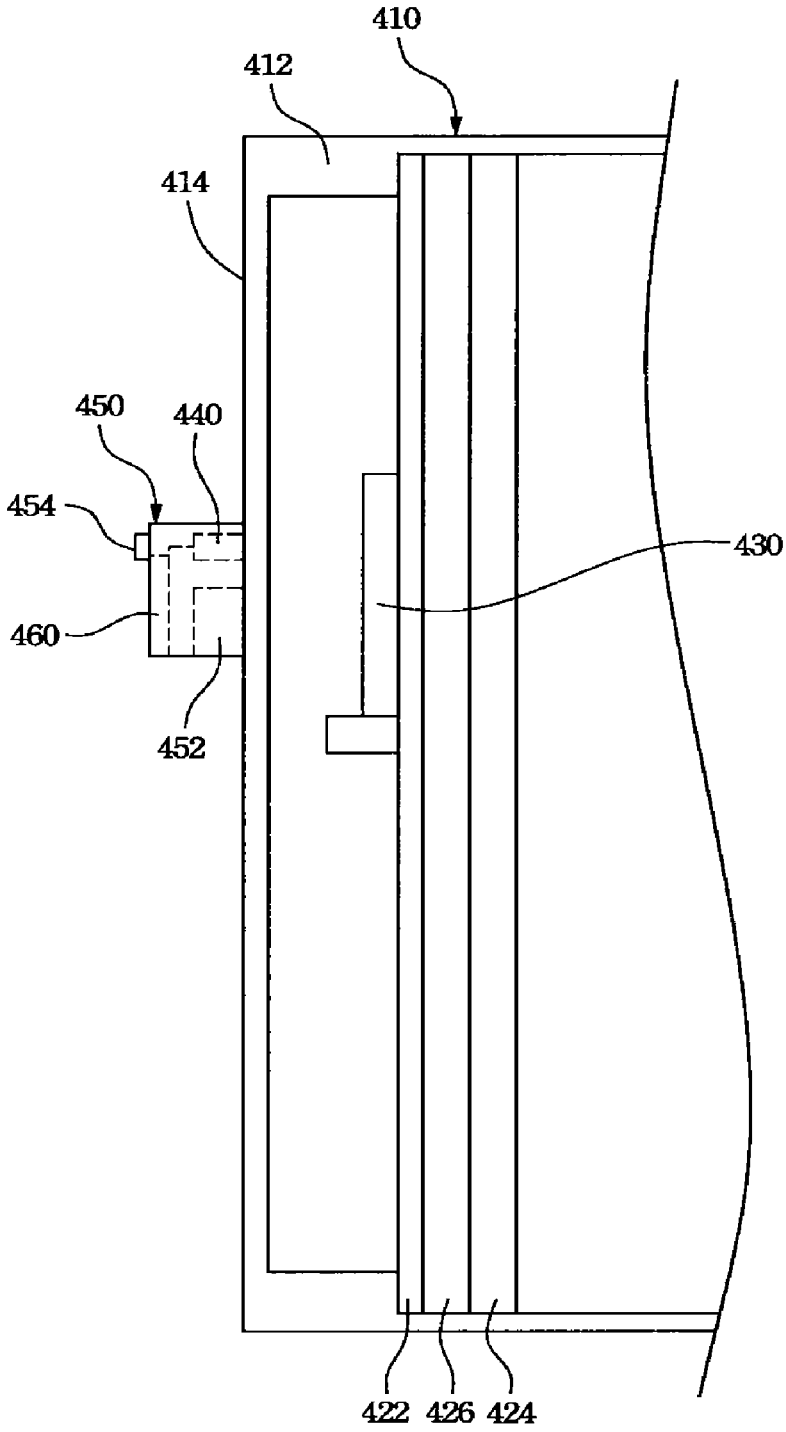
FIG. 4 is a side view showing a multifunction time display device according to a third embodiment of the invention.

FIG. 4 is a side view showing a multifunction time display device according to third embodiment of the invention. Please refer to FIG. 4, a sensor is a photoresistor 440 disposed on a second element 450. An indication element 460 is disposed on the second element 450 and is electrically connected with the photoresistor 440.

A casing 412 of a main body 410 includes a transparent portion 414. The main body 410 further includes a clock face 422, a metal plate 424, and a luminescent plate 426 disposed between the clock face 422 and the metal plate 424. A first element 430 moves on the clock face 422 as time goes by. The second element 450 is attracted on the transparent portion 414 of the casing 412 of the main body 410 via a magnet 452. The first element 430 may be an hour hand or a minute hand, and it is a light-proof element.

A linear indicator 454 on a surface of the second element 450 is used for indicating a position of the photoresistor 440 for increasing accuracy of the time setting. Whereas the first element 430 is a light-proof element, the first element 430 can cover a light source provided by the luminescent plate 426 while the first element 430 moves to overlap the second element 450. Thus the photoresistor 440 disposed on the second element 450 can sense an illumination change for identifying the first element 430.

When the photoresistor 440 on the second element 450 identifies the first element 430 and determines that the first element 430 reaches the set time, the photoresistor 440 transmits a signal to the corresponding indication element 460 to trigger the indication element 460.

According to the above embodiments of the invention, the multifunction time display device can provide different time management functions via the different second elements. The second element is removably attached to the transparent portion of the main body. A user can intuitively dispose the second element on a corresponding position where a time management event expected to happen. And then, the corresponding indication element is triggered while the first element overlaps the second element, Although the present invention has been described in considerable detail with reference to certain preferred embodiments thereof, the disclosure is not for limiting the scope of the invention. Persons having ordinary skill in the art may make various modifications and changes without departing from the scope and spirit of the invention. Therefore, the scope of the appended claims should not be limited to the description of the preferred embodiments described above.

What is claimed is:

1. A multifunction time display device comprising:

a main body including a casing and a metal plate disposed in the casing, the casing having a transparent portion on the metal plate;

a first element moving inside the casing as time goes by;

a second element including a magnet and removably attached to any position of the transparent portion of the casing corresponding to a moving range of the first element via magnetism between the metal plate and the magnet; and an indication element, triggered while the first element moves to overlap the second element.

2. The multifunction time display device according to claim 1, wherein the indication element is disposed in the casing.

3. The multifunction time display device according to claim 1, wherein the indication element is disposed in the second element.

4. The multifunction time display device according to claim 1, wherein the second element is fastened to the transparent portion of the casing via magnetism between the metal plate and the magnet.

5. The multifunction time display device according to claim 1, wherein the first element is an hour hand.

6. The multifunction time display device according to claim 1, wherein the first element is a minute hand.

7. The multifunction time display device according to claim 1, further comprising a sensor electrically connected with the indication element to sense whether the first element moves to overlap the second element.

8. The multifunction time display device according to claim 7, wherein the sensor is a Hall sensor disposed on the first element.

9. The multifunction time display device according to claim 7, wherein the main body further comprises a luminescent plate.

10. The multifunction time display device according to claim 9, wherein the sensor is a photoresistor disposed on the second element.

11. The multifunction time display device according to claim 10, wherein the first element is a light-proof element.

12. The multifunction time display device according to claim 7, wherein the sensor is an electromagnetic sensor, and the electromagnetic sensor includes a receiver and a transmitter disposed on the first element and the second element, respectively.

13. The multifunction time display device according to claim 1, wherein the indication element comprises a sound element or a message element.

14. The multifunction time display device according to claim 1, wherein the second element has a retaining portion.

* * * * *